United States Patent [19]

Hirzinger et al.

[11] Patent Number: 4,523,866

[45] Date of Patent: Jun. 18, 1985

[54] WIRE PRINT HEAD HAVING PIEZOELECTRIC DRIVE ELEMENTS

[75] Inventors: Peter Hirzinger, Wendelstein; Karl-Heinz Vatterott, Duderstadt, both of Fed. Rep. of Germany

[73] Assignee: Triumph-Adler A.G. fur Buro- und Informationstechnik, Nuremberg, Fed. Rep. of Germany

[21] Appl. No.: 516,463

[22] Filed: Jul. 22, 1983

[30] Foreign Application Priority Data

Jul. 24, 1982 [DE] Fed. Rep. of Germany ..... 3227801

[51] Int. Cl.[3] ..... B41J 3/12

[52] U.S. Cl. ..... 400/124; 101/93.05; 310/328

[58] Field of Search ..... 400/124; 101/93.05; 310/328, 330, 331, 332

[56] References Cited

U.S. PATENT DOCUMENTS 4,035,671 7/1977 Schafft ..... 400/124 X 4,362,407 12/1982 Kolm et al. ..... 400/124

4,365,902 12/1982 Biedermann et al. ..... 400/124

FOREIGN PATENT DOCUMENTS 1322876 7/1973 United Kingdom ..... 400/124

*Primary Examiner*—Paul T. Sewell

[57] ABSTRACT

A wire print head is provided with piezoelectric drive elements in the form of strips which are bonded to flexible tabs directed radially inward from a support ring. The ring is secured between a wire guide structure and a cover and the curved surface of the wire guide structure opposite the flexible tabs is grooved whereby contact of the piezoelectric elements on the flexed tabs and the risk of breakage thereof is avoided. The drive ends of the print wires supported in the wire guide structure are directly driven by the ends of the flexible tabs and have no contact with the piezoelectric elements. Further the cover is provided with electrode guards having slots to dissipate heat generated in the flexible tabs.

7 Claims, 5 Drawing Figures

Fig_3
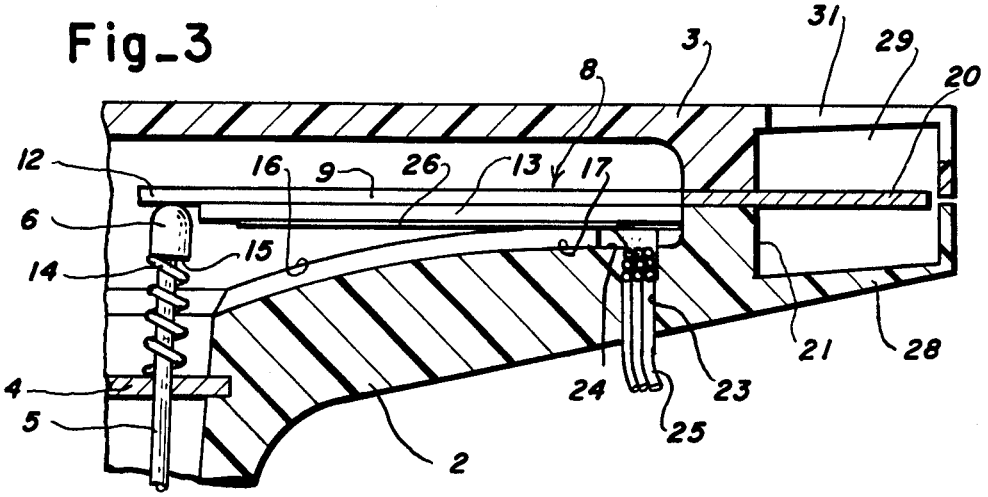
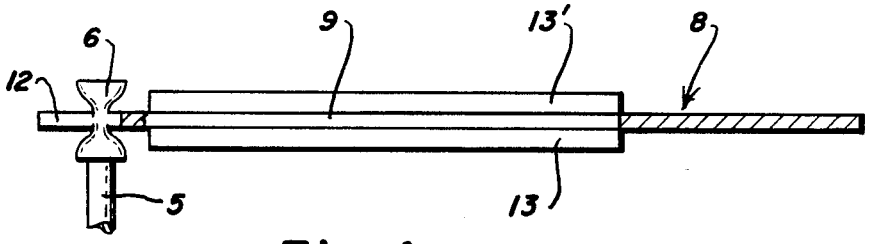
Fig_4
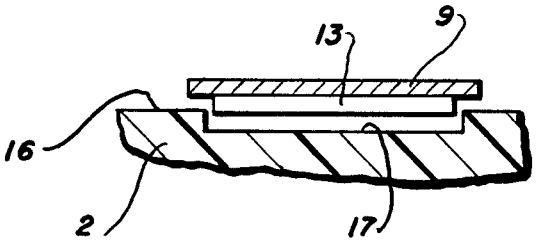
Fig_5

WIRE PRINT HEAD HAVING PIEZOELECTRIC DRIVE ELEMENTS

This invention relates to wire print heads having piezoelectric drive elements; more particularly it relates to wire print heads having piezoelectric drive elements which are supported on flexible tabs so arranged that the print wires are driven directly by the flexed tabs and all contact of the piezoelectric drive elements with the wire guide structure is avoided.

When compared to wire print heads having magnetic drive elements, wire print heads having piezoelectric drive elements offer considerable weight advantages.

An object of the invention therefor is in the provision of a wire print head having piezoelectric drive elements characterized by a minimum of light parts capable of easy assembly.

Another object of the invention is to provide a wire print head having piezoelectric drive elements wherein the piezoelectric elements are free of contact with the print wires and the structure guidingly supporting the print wires.

Another object of the invention is to provide a wire print head having piezoelectric drive elements bonded to flexible tabs which directly drive print wires.

Other objects, features and advantages of the present invention will become better known to those skilled in the art from a reading of the following detailed description when taken in conjunction with the accompanying drawing wherein like reference numerals designate like or corresponding elements throughout the several views thereof and wherein:

FIG. 3 is a partial enlarged vertical cross section similar to FIG. 1 showing print wires normally positioned by return springs;

Figure 1:
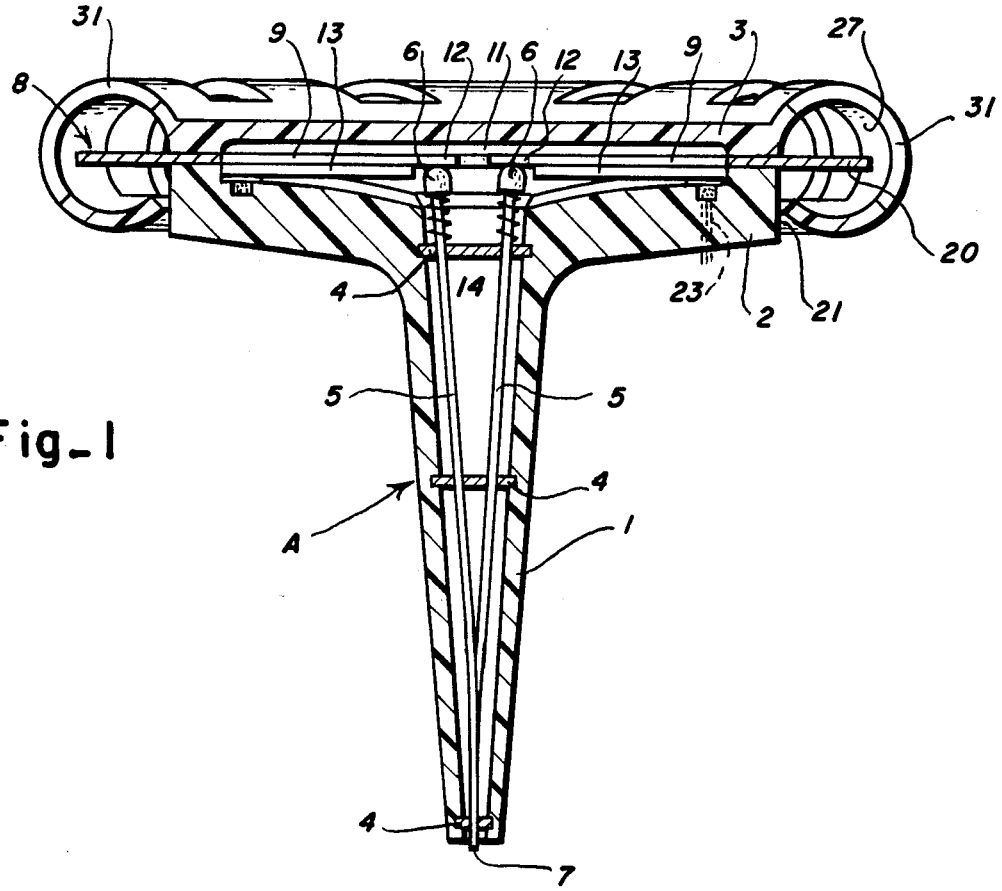
FIG. 1 is a vertical cross sectional view of a wire print head according to the invention.

FIG. 4 is a side view of a mounting ring supporting piezoelectric drive elements on both the top and bottom sides of the flexible tabs and showing an alternative connecting means between the flexible tabs and drive ends of the print wires; and FIG. 5 is a partial cross sectional view showing the relative width dimensions of the tabs, piezoelectric elements and guide structure groove shown in FIG. 3.

Referring now to the drawing there is shown a wire print head generally designated by reference character A comprising a tubular generally conical wire guide structure 1 molded from plastic material having at its wide end an outwardly extending circular flange 2 and a circular cover 3 also molded of plastic material adapted to be suitably bolted to the periphery of the flange 2. Within the interior of the wire guide structure 1 there are suitably perforated guides 4 for guiding print wires 5 having headed drive ends 6 arrayed about a circle and print ends 7 arrayed in a line as is conventional.

Figure 2:
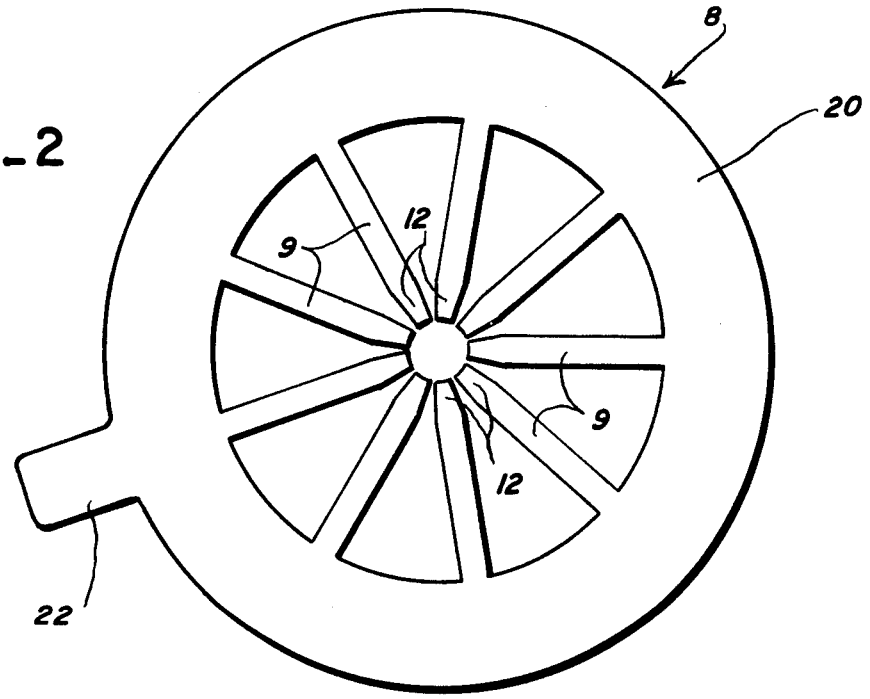
FIG. 2 is a plan view of a mounting ring having flexible tabs adapted to support piezoelectric drive elements.

As shown in FIG. 1 a circular ring 8 is secured between the cover 3 and flange 2 during assembly. The ring 8 as shown in FIG. 2 has a plurality of radial tabs 9 which extend into a central cavity 11 between cover 3 and flange 2 toward the axis of the ring 8 with the ends 12 of the tabs 9 overlying the headed drive ends 6 of associated print wires 5 whose number corresponds to the number of tabs 9.

As shown in FIGS. 1 and 3–5 piezoelectric ceramic drive elements in the form of rectangular strips 13 are bonded to the bottom side of flexible tabs 9. As shown in FIG. 1 the strips 13 are located on the tabs 9 within the cavity 11. They do not however extend to the ends 12 of the flexible tabs 9 and therefore do not contact the headed drive ends 6 of the print wires 5.

With reference to FIG. 3 the print wires 5 are shown in contact with the ends 12 of the unflexed tabs 9 by coiled return springs 14 surrounding the print wires 5 and acting between a shoulder 15 formed by the headed ends 6 thereof and the top surface of the flange or the uppermost guide 4 within the wire guide structure 1.

FIG. 4 shows an alternative connection between the headed drive ends 6 of the print wires 5 and the tabs 9, wherein the ends 12 of the flexible tabs 9 are forked and the headed drive ends 6 of the print wires have a dumbbell shape for insertion in the forked ends 12 of the tabs 9.

With further reference to FIGS. 3 and 5 the flange 2 of the wire guide structure 1 on the side facing the cavity 11 has a curved surface 16 to guide the flexural movement of the tabs 9 when driven by the piezoelectric elements 13. The flange 2 is further provided opposite tabs 9 with radial clearance grooves 17 sufficiently deep so that the driven piezoelectric elements 13, which are made narrower in width than the flexible tabs 9, and narrower than the clearance grooves 17, do not come in contact with the flange surface 16 when driven by print signals. Thus only the tabs 9 when flexed come in contact with the curved surface 16 of the flange 2 on either side of the clearance grooves 17 as shown in FIG. 5.

In accordance with the invention the diameter of the ring 8 is such that when mounted, its periphery 20 extends beyond the periphery 21 of the flange 2 thereby to allow heat generated in the center to be conducted to the exterior of the cavity 11. The ring 8 may be made of stamped metal and include a radially, outwardly extending tab 22 for connection to electrical ground. Thus the ring 9 serves as a ground electrode common to one face of all the piezoelectric drive elements 13. To connect print signals to the other opposite faces of the piezoelectric elements 13, the flange 2 is provided with a hole 23 which connects with an annular groove 24 (FIG. 3) formed in the flange surface 16. Signal wires 25 are brought into the holes 23 and around the annular groove 24 for connection to signal electrodes 26 bonded to the other face of the piezoelectric elements 13.

With reference again to FIGS. 1 and 3 the periphery 20 of the ring 8 extending beyond the periphery 21 of flange 2 is guarded against physical contact by, as shown in FIG. 1, forming the periphery of the cover 3 to provide a circular annulus 27, or as shown in FIG. 3, forming the periphery of the cover 3 and an extension 28 of the flange 2 to provide a box shaped annulus 29. As shown in FIG. 1 and FIG. 3 the circular and box shaped annulus are provided with radial slots 31 sufficient to provide ventilation for dissipation of heat conducted to the periphery 20 of the ring 8 yet too narrow to permit physical contact with the ring 8.

FIG. 4 shows flexible tabs 9 supporting piezoelectric elements 13 and 13' on both the bottom and top sides of the tabs 9 as may be desirable for special applications. In this embodiment the upper strip 13' would be elongated while the lower would be shortened in response to print signals.

The ring 8 may be formed as a single punched piece of steel, for example, and in special cases of spring steel. In the embodiment of FIG. 4 the ring would preferably be formed of aluminum.

The invention makes it possible to provide a low mass wire print head assembly A which is economical to manufacture and assemble and which is so constructed to confine noise to the cavity 11, yet allow outward dissipation of heat during operation.

The invention claimed is:

1. A wire print head comprising a generally cone shaped tubular wire guide structure having a circular flange at its large end, print wires supported by said wire guide structure having a drive end and a print end, said print wires being supported within said wire guide structure with the drive ends in a circle array and with said print ends in a line array, a circular cover member secured to said flange and defining a cavity therebetween, a ring clamped between said cover member and said circular flange having radial tabs extending into said cavity toward the center of said ring with the free ends of said tabs in driving contact with the drive ends of associated print wires, and piezoelectric drive elements bonded to each of said tabs operable when driven by print signals to flex said tabs thereby to drive associated print wires, said circular flange having a curved surface on the side defining said cavity, said curved surface having radial grooves opposite said radial tabs of a width less than the width of said radial tabs and more than the width of said piezoelectric drive elements, said curved surface serving to guide movement of flexed tabs and said grooves allowing non contacting movement of driven piezoelectric drive elements.

2. A wire print head as recited in claim 1, said print wires mounting cylindrical return springs located between a shoulder adjacent the drive ends of said print wires and the flange of said guide structure.

3. A wire print head as recited in claim 1, said print wires being connected at the drive ends thereof to the ends of said tabs.

4. A wire print head as recited in claim 1, said tabs supporting a piezoelectric element on the upper and lower sides thereof.

5. A wire print head as recited in claim 1, including print signal connections to one face of said piezoelectric elements and a common connection to said ring.

6. A wire print head as recited in claim 1, wherein the periphery of said ring extends beyond said cavity and wherein said cover member has an extension guarding the periphery of said ring, said cover member extension having radial slots for venting heat.

7. A wire print head as recited in claim 6, said extension of said cover member extending beyond and around the periphery of said ring.

* * * * *